US005906083A

United States Patent [19]

Olsen et al.

[11] Patent Number: 5,906,083

[45] Date of Patent: May 25, 1999

[54] MODULAR LOUVER SYSTEM

[75] Inventors: Robert W. Olsen, Washington, N.J.; William Vincent, Georgetown, Canada; Todd Norman Bartlett, Westfield, N.J.

[73] Assignee: Construction Specialties, Inc., Lebanon, N.J.

[21] Appl. No.: 08/905,863

[22] Filed: Aug. 4, 1997

[51] Int. Cl.[6] ..... E06B 7/08

[52] U.S. Cl. ..... 52/473; 52/204.61; 52/209; 52/302.1; 52/302.3; 52/656.7; 52/656.8; 454/277; 454/281; 454/283

[58] Field of Search ..... 52/473, 209, 204.61, 52/302.1, 656.8, 656.6, 663, 302.3, 204.5, 198, 199; 454/277, 279, 281, 282, 283, 309; 49/74.1, 91.1

[56] References Cited

U.S. PATENT DOCUMENTS

| | | | |
|---|---|---|---|
| 1,713,748 | 5/1929 | Feinberg et al. | 454/277 X |
| 2,936,874 | 5/1960 | Bierwirth et al. | 454/283 X |
| 2,988,183 | 6/1961 | Hallock | 52/473 |
| 3,332,335 | 7/1967 | Hillstrom | 454/277 |
| 3,358,580 | 12/1967 | Freese et al. | 454/277 |
| 3,362,123 | 1/1968 | Geyser | 52/773 |
| 3,390,625 | 7/1968 | Maxson . | |
| 3,625,136 | 12/1971 | Dininno . | |
| 3,771,430 | 11/1973 | Lane . | |
| 3,844,077 | 10/1974 | Vance | 52/209 |
| 3,858,375 | 1/1975 | Silvernail | 52/209 X |
| 4,592,271 | 6/1986 | Young | 454/277 |
| 4,706,554 | 11/1987 | Baldino et al. . | |
| 4,733,515 | 3/1988 | Schmidlin . | |
| 4,958,555 | 9/1990 | Lentz et al. | 454/277 |
| 5,123,224 | 6/1992 | Olsen . | |
| 5,297,373 | 3/1994 | Olsen | 52/473 |
| 5,542,224 | 8/1996 | Olsen . | |
| 5,601,485 | 2/1997 | Gigola | 454/277 |
| 5,755,069 | 5/1998 | Sullivan | 52/473 |

FOREIGN PATENT DOCUMENTS

| | | |
|---|---|---|
| 1106384 | 3/1968 | United Kingdom . |
| 2165039 | 4/1986 | United Kingdom . |
| 2255629 | 11/1992 | United Kingdom . |
| 2261064 | 5/1993 | United Kingdom . |
| 2300473 | 11/1996 | United Kingdom . |

OTHER PUBLICATIONS

"The ILI Louver Guide" Industrial Louvers, 1995 Sweets General Building & Renovation Catalog, Section 10200/IND.

"Greenheck Louvers", Greenheck, 1995 Sweets General Building & Renovation Catalog, Section 10200/GRE.

Livingston, James; Ruskin Engineering Report entitled "Topic: Louver Wind Driven Rain Performance;" Report No. 996:1; Sep., 1996.

Paper entitled "FGD Mist Eliminators for 0.002 LB/MMBTU Solid Particulate Emission" (#93–JPGC–EC–9); presented at the Joint ASME/IEEE Power Generation Confeence, Kansas City, Kansas, Oct. 17–22, 1993.

Munters Product Sheet TS–5 5–93/PP2000, TS–5 Series, Horizontal Flow Mist Eliminators (4 pages).

Munters Product Sheet T100B/01–95 D/3000, T–100, Mist Eliminators, Horizontal Flow (4 pages) Rev. O Jul. 1992.

The C/S Group Catalog "C/S Louver Systems," (10200/CON) Series 95, 1993.

*Primary Examiner*—Carl D. Friedman
*Assistant Examiner*—Laura A. Callo
*Attorney, Agent, or Firm*—Baker & Botts, L.L.P.

[57] ABSTRACT

A modular louver assembly comprises a peripheral frame having a sill, a header and jambs defining a rectangular primary opening, a plurality of intermediate frame members joined to the peripheral frame and dividing the primary opening into a plurality of rectangular modular unit openings, and either louver modules or blank-off panels received in the unit openings. A sight screen mounted on the framework overlies substantially the entire primary opening.

30 Claims, 10 Drawing Sheets

MODULAR LOUVER SYSTEM

BACKGROUND OF THE INVENTION

Louvers are widely used in the walls of commercial, industrial, and institutional buildings at openings provided for various purposes, the most common purposes by far being for intake and exhaust of air for ventilation and for cooling of equipment. Often, several intake or exhaust openings are located in a cluster, such as at the exterior wall of an equipment room or floor. In high-rise buildings, equipment rooms are provided on certain floors and serve several adjacent floors above and below. In low-rise or one-story buildings, protected equipment enclosures may be provided on the roof, or one or more equipment rooms may be provided on a floor as required. In both instances, the openings at the building wall to ducts or to equipment spaces are often clustered.

The main function of a louver is to remove rain or snow ("moisture") from an air stream passing from the outside through an opening into a duct or space covered by the louver. The degree to which a louver is effective in removing moisture is a function of several aspects of the design of the louver, such as the slope and pitch distance of the blades, the configuration of the blades, the depth (the dimension perpendicular to the wall), and the blade orientation. In general, the more effective a louver is in removing moisture, the greater is the pressure drop across it. Inasmuch as it is desirable to minimize the pressure drop through a louver in order to avoid a waste of energy in drawing air in or pushing air out, the choice of a louver installation involves to some extent a compromise between effectiveness of moisture exclusion and energy efficiency.

Architects and building owners are also keenly interested in the appearance of the buildings they design and own. An element of the appearance of a building is the treatment of louvers. Uniformity of appearance is usually a design objective, one that very strongly favors horizontal blade louvers. Attaining uniformity of appearance often conflicts with both effectiveness of water removal and energy efficiency in several ways. First, for any given energy efficiency, vertical blade louvers are significantly more effective in removing moisture than are horizontal blade louvers, but vertical blade louvers change in appearance, depending on the vantage point of the viewer. Second, removal of moisture at an exhaust opening is significantly less difficult, because the air flow repels rather than induces moisture intake, and it is often less important to remove moisture at an exhaust opening than it is at an intake opening, but uniformity of appearance often leads the architect and owner to use the same louvers for both intake and exhaust openings. Third, worst case probable wind conditions used in design suggest the use of different louvers in different walls, depending on prevailing winds, another conflict with uniformity of appearance.

Previously known louvers are often custom-designed and built for particular installations, albeit based on standard blade and frame configurations. Each louver is a stand-alone unit and is separately fastened to elements of the building framing system, often in a manner that makes removal difficult at best. Custom design and manufacture increases costs. Permanent installation in the building wall makes repair or replacement of the louver difficult and expensive.

SUMMARY OF THE INVENTION

One object of the present invention is to provide a louver system that allows an architect considerable freedom in creating a desired exterior appearance for a louver installation, which will ordinarily be a uniform geometric pattern. Another object is to enable louvers of various configurations suited to the requirements (e.g., intake or exhaust or prevailing winds) to be used in the same building and in proximity to one another. It is also an object to permit blank-off panels to be installed as needed. Also, it is desired to facilitate installation and removal for cleaning, repair or replacement of louvers. Yet an additional object is providing for effective handling of water captured by the louvers. One aspect of the invention, in that regard, is the ability to use louvers that are highly effective in capturing moisture. It is, furthermore, an objective of the present invention to enable cost reductions for a louver installation by mass production of modular louver units and uses of materials and finishes that offer additional savings.

The foregoing objects are attained, according to the present invention, by a modular louver assembly that comprises a peripheral frame having a sill, a header and jambs defining a rectangular primary opening, a plurality of intermediate frame members joined to the peripheral frame and dividing the primary opening into a plurality of rectangular modular unit openings, a louver module received in at least one of the unit openings, and a sight screen mounted on the framework and overlying substantially the entire primary opening.

The modular form of the louver assembly of the present invention has many advantages, including:

- considerable versatility in the choice of louvers, which may be selected to best meet the functional requirements of the particular opening and the location of the opening with respect to prevailing winds, without regard for external appearance;
- improved overall energy efficiency, which is derived from the freedom of selection of louver designs from the functional point of view;
- considerable freedom for the architect to select a desired appearance by means of a sight screen, which may be essentially non-functional as far as moisture removal is concerned; an architect can select virtually any open grid as a sight screen and can also vary the forms of open grid in a given expanse;
- the ability to mass-produce modular louver units, which are interchangeable within the unit openings of the framework;
- the ability to use low-cost materials, such as blades of plastics that are not resistant to ultra-violet radiation or metal blades that have low-cost finishes;
- the possibility of providing for admission of light through louvers and blank-off panels that are made of transparent or translucent plastics or glass in the case of blank-off panels;
- ease of removal of the louver units for repair or replacement, as well as ease of initial and replacement installation; this feature is very useful when the configuration of an equipment space is changed.
- the unit openings of the framework may receive bird screens, filters, and other accessory parts associated with ventilation systems.

In preferred embodiments of the present invention, the louvers have vertical blades, which are highly effective in removing moisture and for any given energy efficiency are significantly more effective in removing moisture than are horizontal blade louvers. Horizontal blades are subject to splashing of raindrops that impinge on the blade surfaces, thus creating droplets that are prone to becoming entrained in the air flow and passing through the louver. Impingement of rain on vertical blades deflects most drops with little splashing and produces less misting and less moisture entrainment. Water that clings to the surfaces of vertical blades flows readily down the blades to the bottom of the louver, whereas water that clings to the blades of horizontal louvers can be blown to and off the downstream edges of the blades. Although the configuration of the blades of vertical louvers can vary, good results are obtained with blades that are generally V-shaped in cross section, are rounded at an apex between front and rear leg portions, and have a first water-trapping hook-shaped rib at the apex and a second water-trapping hook-shaped rib at a rear extremity of the rear leg portion. Z-shaped blades are also well-suited for use in the system.

The modular system facilitates the use of different louver modules in different unit openings of the framework, each louver module being selected to have specified water-trapping characteristics, based on design criteria that include the air intake flow rate, the acceptable water carryover rate, and the direction of the prevailing winds with respect to the direction in which the louver unit faces. The principal variation among units will usually involve the blade spacing, closer spacings providing greater effectiveness, albeit with increased pressure drop and reduced energy efficiency.

For unit openings where highly effective louvers are not required, louver units with horizontal blades, which are typically more energy efficient (exhibit less pressure drop), may be used. That can be the case with exhaust openings and installations in walls that face away from prevailing winds or are otherwise not subject to high winds, such as by being shielded by nearby structures.

The modular louver system of the invention also facilitates the use of blank-off panels in unit openings that are not used for air intake or exhaust. Architects may prefer for aesthetic reasons to have louvers extend horizontally across a large expanse, even though only part of the wall involved is used for air intake or exhaust. Blank-off panels make it possible to close off interior space for other uses, such as for workrooms or storage rooms. In such cases, the blank-off panels can be constructed to be thermally insulating and incorporate seals that engage the framework of the louver system to make the unit openings air-tight. As mentioned above, if it is desired to admit light to the closed off space, the blank-off panels may be like windows, with one or more sheets of clear or translucent plastic or glass mounted in a frame. An exemplary blank-off panel may have a frame and a sandwich panel mounted in the frame, the sandwich panel having a core of a thermally insulating material and skins of rigid sheet material.

Preferred embodiments of the louver system of the present invention are constructed with a framework that incorporates a water handling system for the louvers. The sill of the main peripheral frame is generally U-shaped such as to define a water-collection channel. The intermediate vertical frame members are joined to the sill and header and are tubular so as to serve as conduits for carrying water to the sill. The intermediate horizontal frame members are channel-shaped and connected between the jambs and the intermediate frame members and, like the sill, serve as drainage channels. Each intermediate vertical frame member has openings to receive water from the drainage channels of the intermediate horizontal frame members. Water captured by each louver unit received in a unit opening above a horizontal frame member is collected in the drainage channel and is carried off to either side, passes thorough the openings in the vertical frame members and flows down to the sill, from which it can be piped away or allowed to flow through holes in the sill onto flashing and drain down the building wall.

Each intermediate vertical frame member may formed by two longitudinally coextensive, laterally adjacent, generally U-shaped pieces mated side by side at slip joints. Each intermediate horizontal frame member has screw bosses that receive screws having heads within one piece of the adjacent intermediate vertical frame member, the screws having been installed before the pieces were mated. That construction makes it possible to factory-assemble frame sub-assemblies of a size suitable for convenient transport to a job site, each subassembly consisting of a header, a sill, one or more intermediate horizontal frame members and one piece of each intermediate vertical frame member fastened to each end of the header, sill and intermediate horizontal frame member(s). The frame subassemblies are installed in the peripheral frame seriatim, beginning at one end and working horizontally toward the other end or beginning at any location and working out to the ends.

The sight screen may be essentially decorative and not intended to serve as a louver, that is, to remove water from the airstream. It is, on the other hand, possible to design the sight screen to provide for moisture removal. In some conditions, such as exhaust openings and at walls not subject to high winds, unit openings may be left open. An architect has considerable freedom to choose an aesthetically pleasing sight screen. Preferably, the sight screen provides a large open area and produces a minimum pressure drop, lest it impede air flow and waste energy by making fans work harder to induct and expel air. The sight screen may also serve as a sun screen by shielding the louver units and blank-off panels installed behind the screen from direct sunlight. If the sight screen is also a sun screen, the louver units and blank-off panels may use materials that are not resistant to ultraviolet radiation. For example, the louver blades may be made of a low cost plastic which is not formulated to be resistant to deterioration by sunlight. The sight screen also makes it unnecessary to provide special finishes, which are generally costly, on the louver units and blank-off panels. One example of a sight screen is a uniform array of sloping horizontal blades supported by brackets, which are affixed to the jambs and intermediate vertical frame members of the framework. The owner of the present invention, Construction Specialties, Inc. ("C/S") and its affiliates produce and market lines of sight screens and grilles under the trademarks Modular™ and Myriad™, some of which are well-suited for use in the present invention.

For a better understanding of the present invention, reference may be made to the following description of exemplary embodiments, taken in conjunction with the accompanying drawings.

Figure 12:
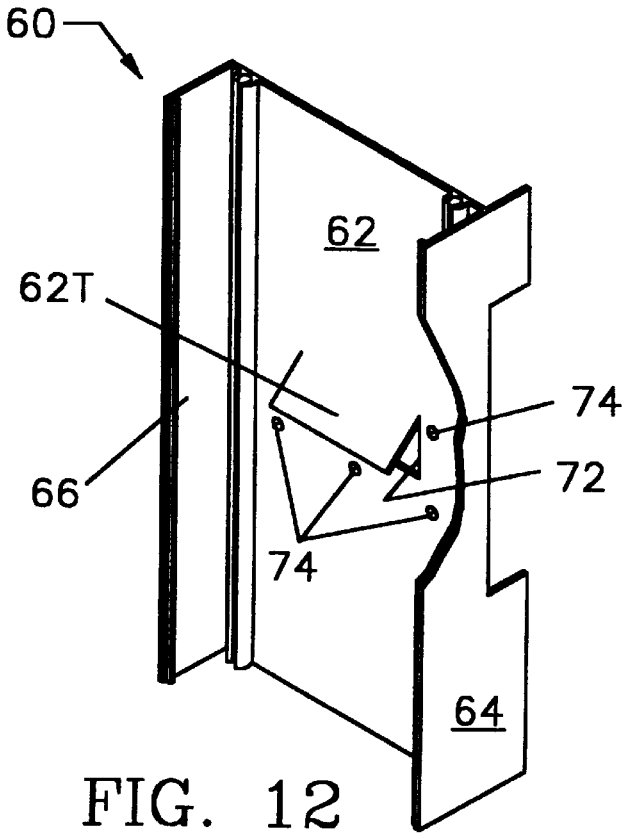
Figure 11:
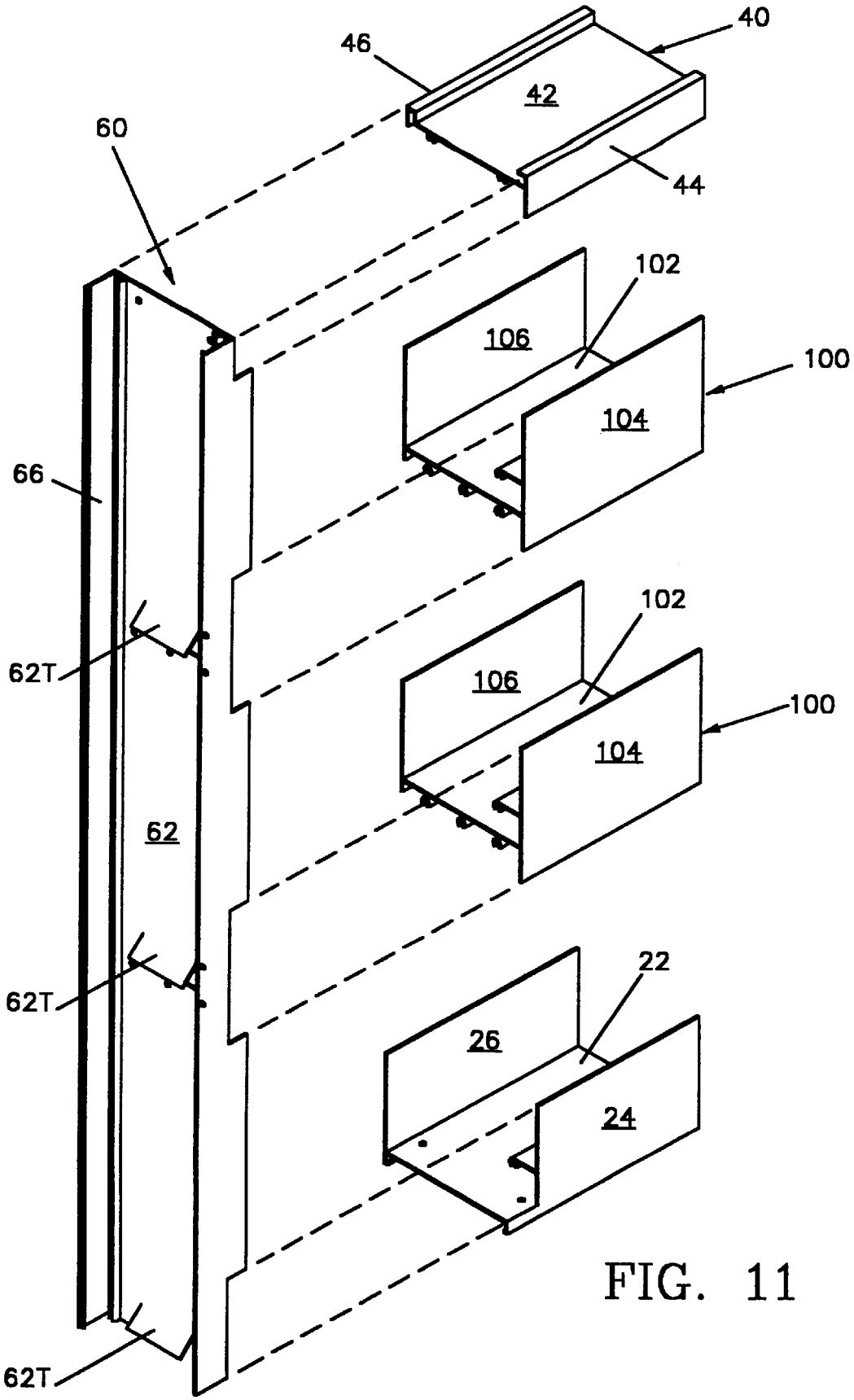
Figure 13:
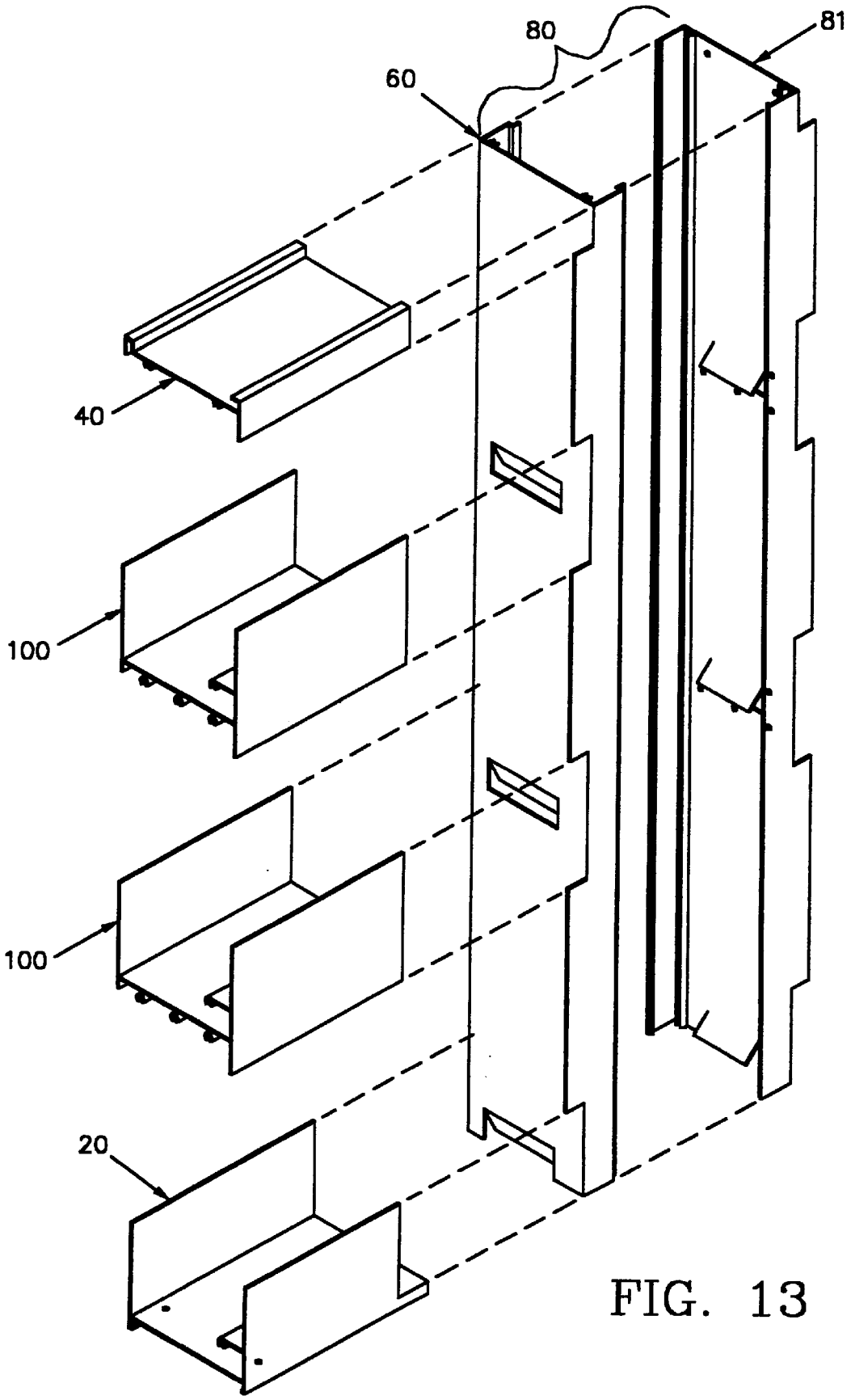
Figure 14:
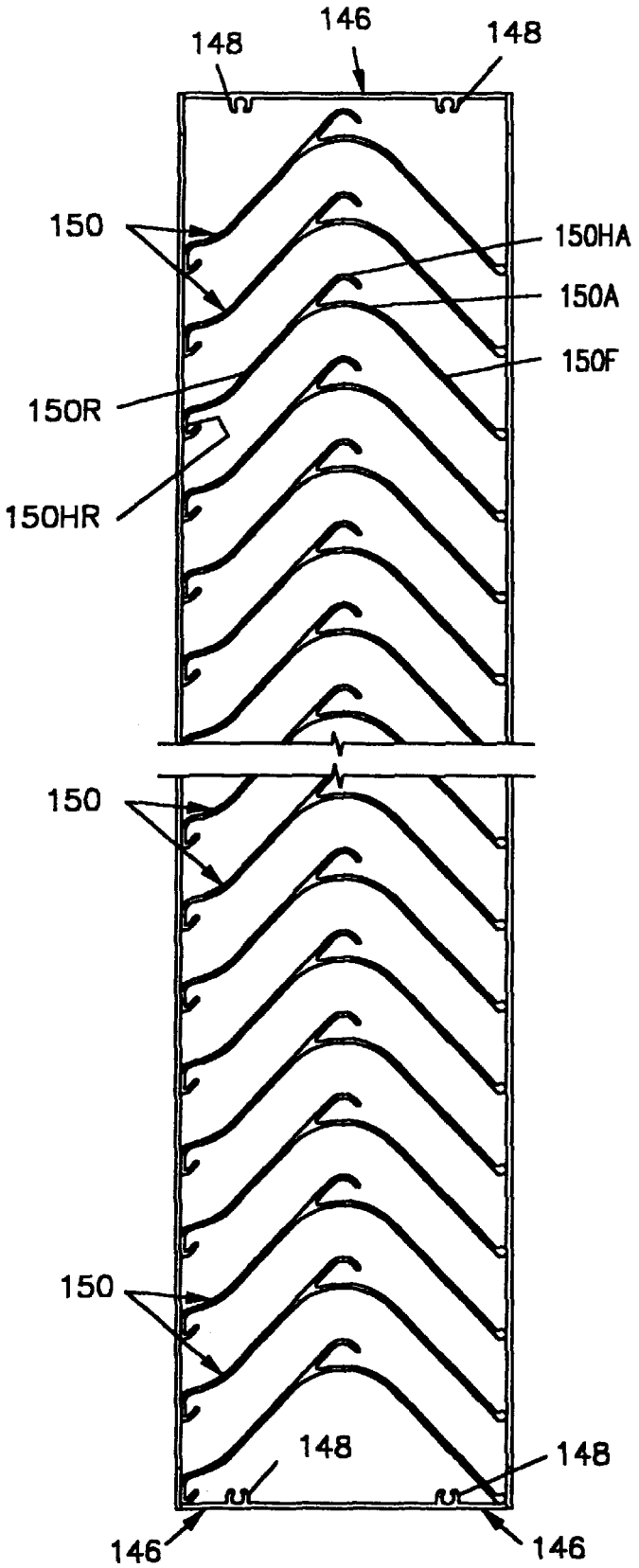
Figure 15:
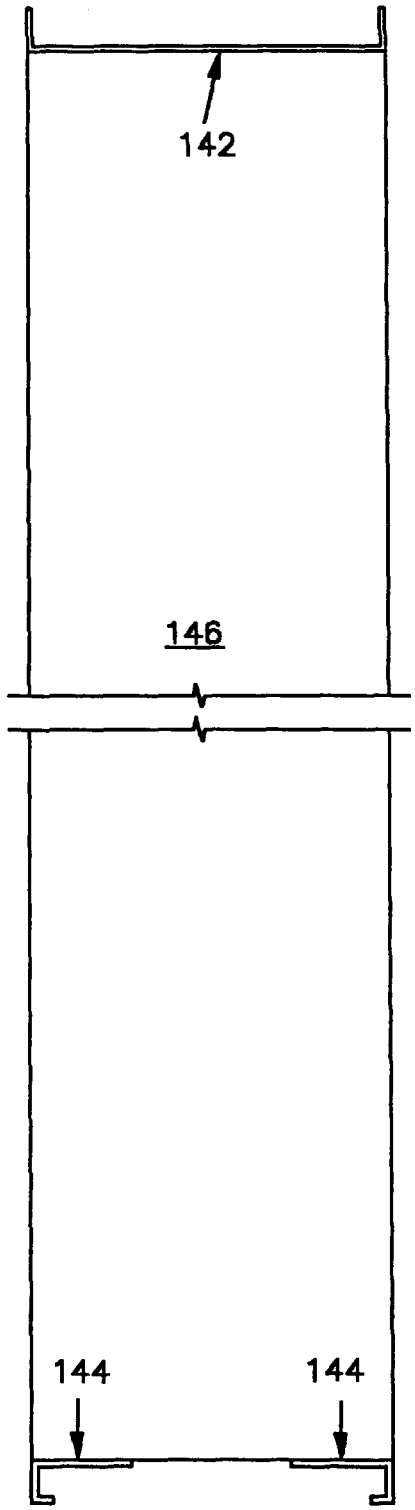
Figure 16:
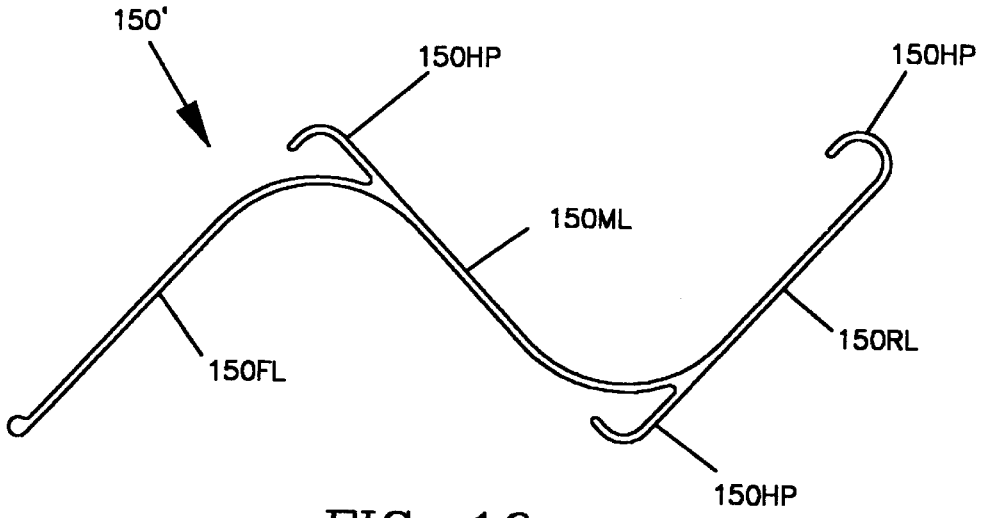
Figure 17:
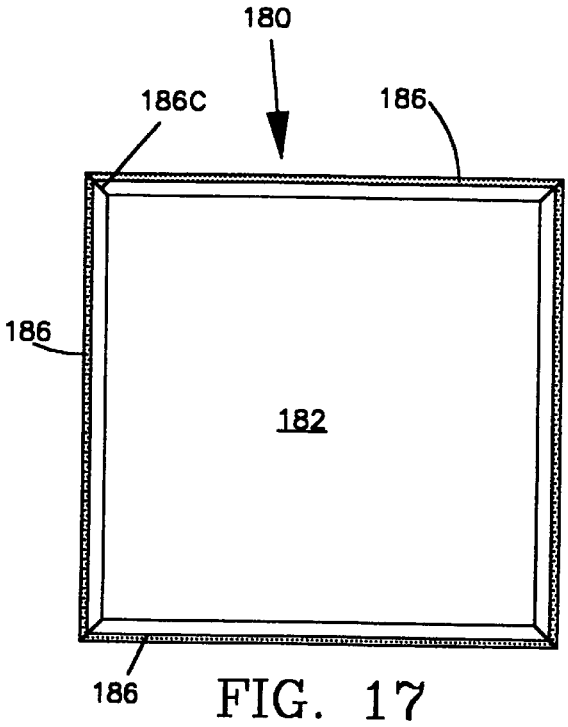

5—a sill;

6—a header;

7—a jamb, which also is used for one-half of each intermediate vertical frame member;

8—a snap-in jamb cover;

9—a half intermediate vertical member;

10—an intermediate horizontal frame member;

FIG. 11 is an exploded perspective view of the jamb and portions of the sill, header, and intermediate horizontal frame members of the louver framework;

FIG. 12 is a perspective view of a portion of a jamb;

FIG. 13 is an exploded perspective view of an intermediate frame member and portions of the sill, header and intermediate horizontal frame members;

FIG. 14 is a top cross-sectional view of a vertical blade louver unit, a portion being broken away;

FIG. 15 is an end elevational view of the louver unit of FIG. 14, a portion being broken away;

FIG. 16 an end view of a "Z" blade suitable for a vertical blade louver unit;

FIG. 17 is a rear elevational view of a blank-off panel; and

Figure 18:
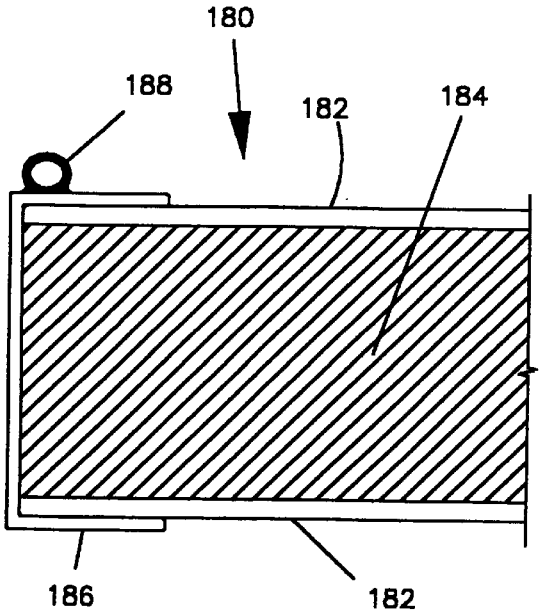

FIG. 18 is a detail cross-sectional view of an edge portion of the panel of FIG. 17.

DESCRIPTION OF THE EMBODIMENTS

Figure 2:
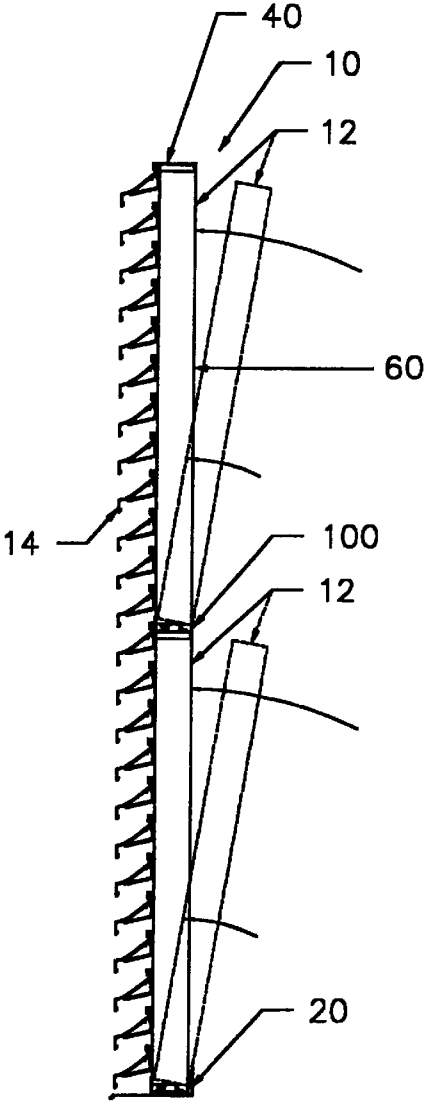
FIG. 2 is a schematic side cross-sectional view of the louver system of FIG. 1.
Figure 1:
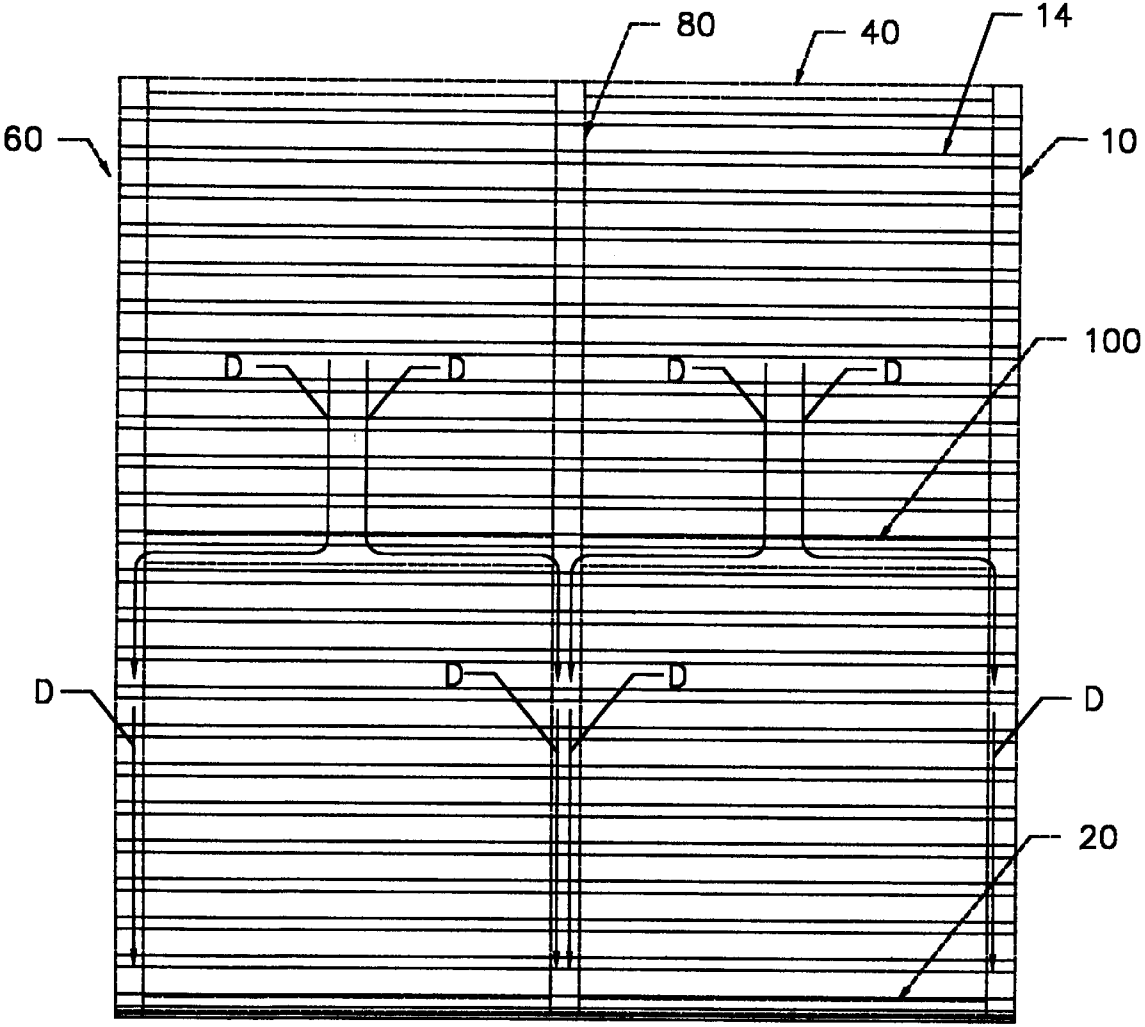
FIG. 1 is a schematic front elevational view of an embodiment of a modular louver system according to the present invention.

The modular louver system shown generally schematically in FIGS. 1 and 2 consists of a framework 10, which is shown by dashed lines in FIG. 1 because it is not visible from the exterior (the aspect shown in the figure), louver units or blank-off panels 12, which are installed in unit openings formed by the framework 10, and a sight screen 14, which is mounted on the framework on the external side (the side facing out from the building) and is coextensive with the primary opening formed by the perimeter frame members. The perimeter frame members are: a sill 20; a header 40; and two jambs 60, one at each side. The sill and header each may consist of aligned separate pieces, as described below. One or more intermediate vertical frame members 80 extend between and are attached to the sill 20 and header 40. The jambs 20 and intermediate vertical frame members 80 extend the full height of the framework between the sill and the header. An intermediate horizontal frame member 100 extends between and is attached to adjacent vertical members of the framework, which may, of course, be either a jamb 60 or an intermediate vertical frame member 80. The intermediate vertical and horizontal frame members 80 and 100 subdivide the primary opening formed by the peripheral frame into unit openings. The size of the primary frame may be varied as desired, subject to structural limitations on the height between the sill and header and the strength of the intermediate vertical frame members. The length (horizontally) is unlimited, inasmuch as the sill and header pieces or the ends of the jambs and the intermediate frame members, or both, may be fastened to the building structure. The sizes of the unit openings of the framework may also be varied. Suitable sizes are 3 ft.×3 ft., 4 ft.×4 ft., 3 ft.×4 ft. And 4 ft.×3 ft. The unit openings of an installation may be of the same size or a mix of sizes.

Figure 3:
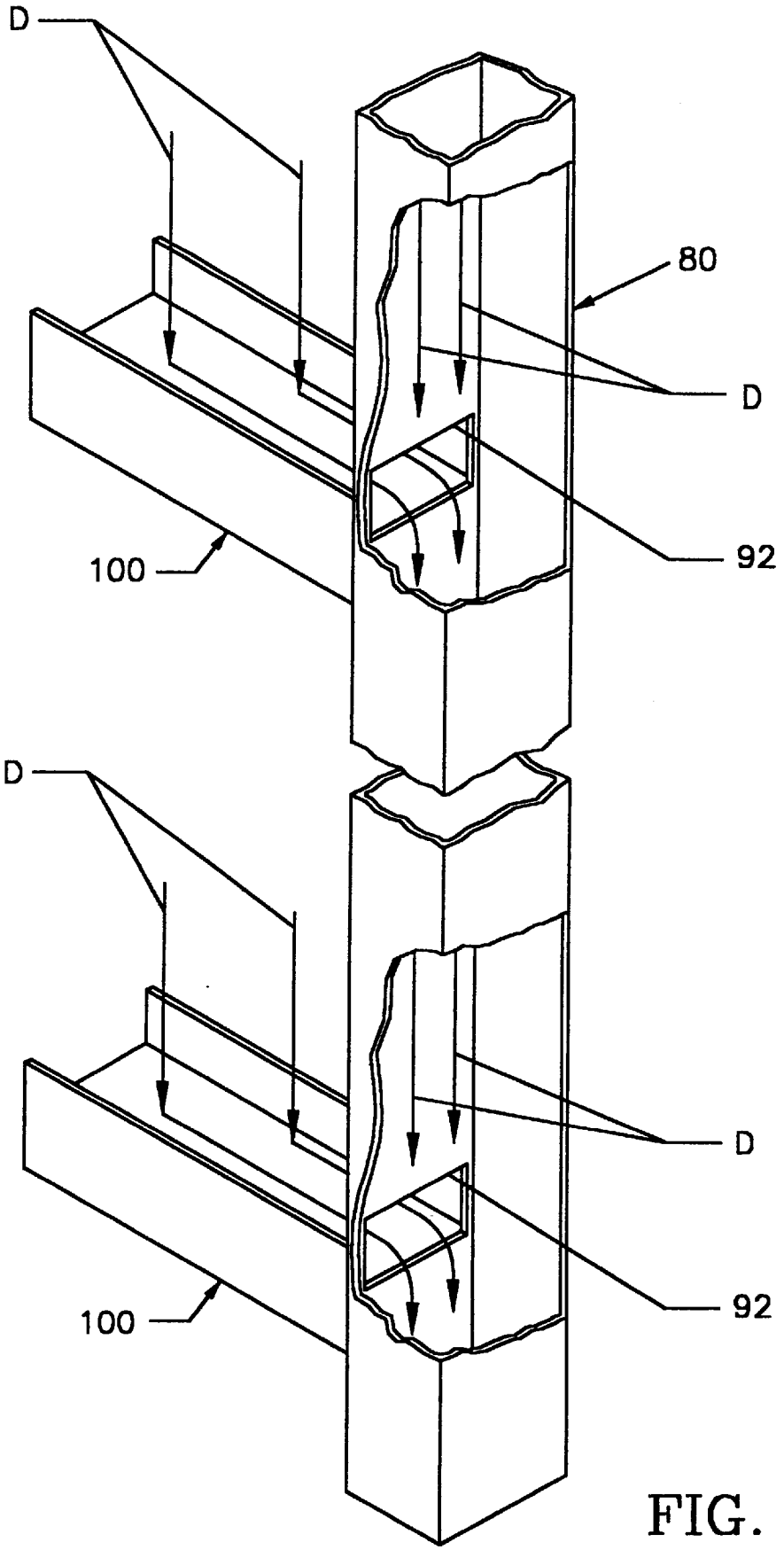
FIG. 3 is a pictorial view in schematic form of portions of the framework of the louver system, showing how water removed by the louver units from the airstreams is handled by the framework.

The framework is constructed to collect water removed from the airstreams by the louver unit (examples described below) in each unit opening in the sill 20 or intermediate horizontal frame member 100 of the unit opening in which it is installed and conduct it to the sill and thence to a downspout or flashing under the sill. The sill and each intermediate horizontal frame member is channel-shaped (see FIG. 3) and serves as a collection trough and drainage channel for water. At least one of the vertical members (i.e., a jamb 60 or an intermediate vertical frame member 80) to which each intermediate horizontal frame member is joined is tubular and has drain holes 92 to receive water from each horizontal intermediate frame member 100 connected to it and to release water from it to the sill. The drainage paths of the modular louver are indicated by the arrowed lines D in FIGS. 1, 3 and 4. It is apparent that the louver units in the unit openings immediately above the sill 20 drain the water they capture to the sill.

Figure 4:
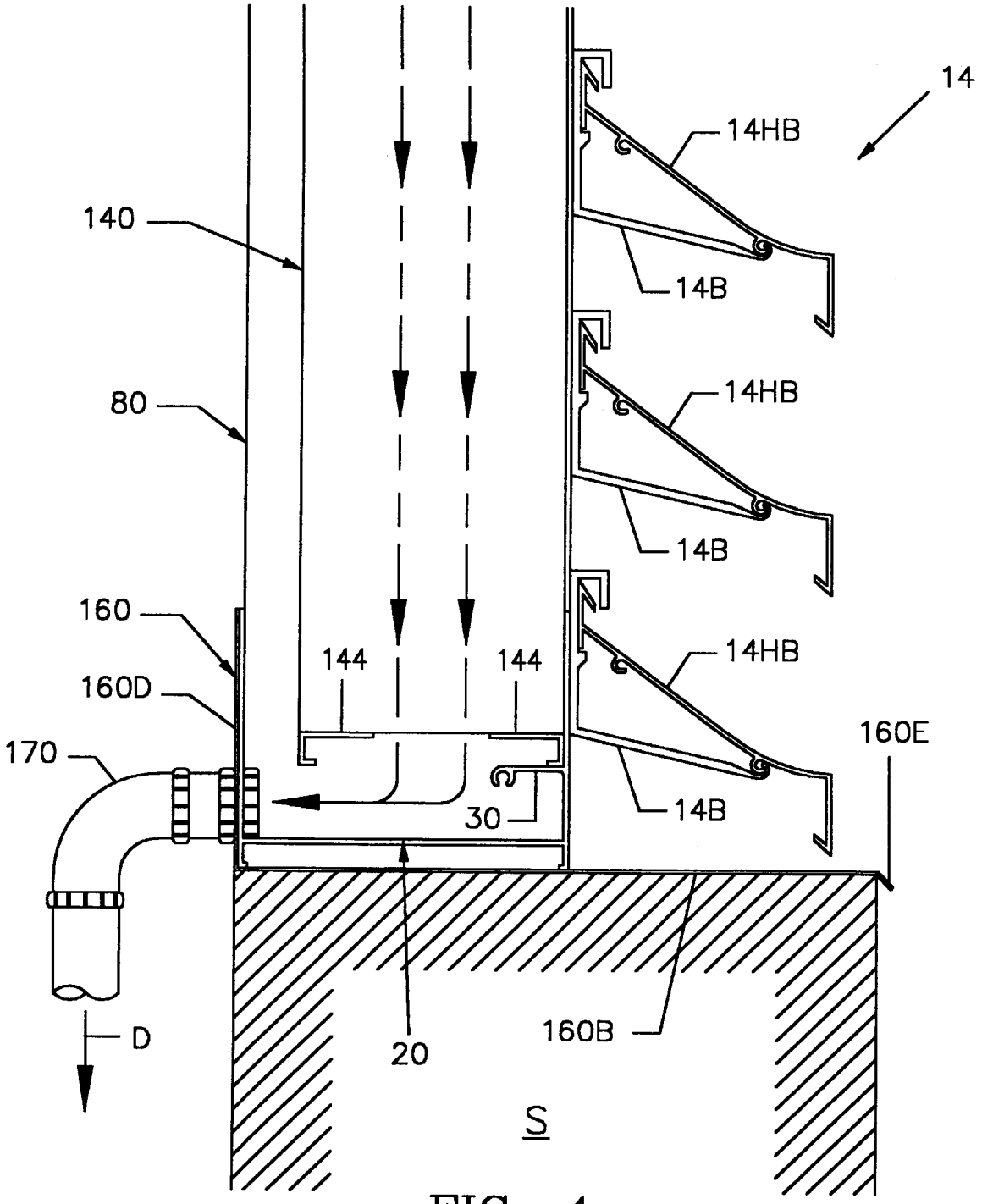
FIG. 4 is a fragmentary side cross-sectional view of the bottom portion of a louver system, showing a pipe connected to the sill for taking water away.
Figure 6:
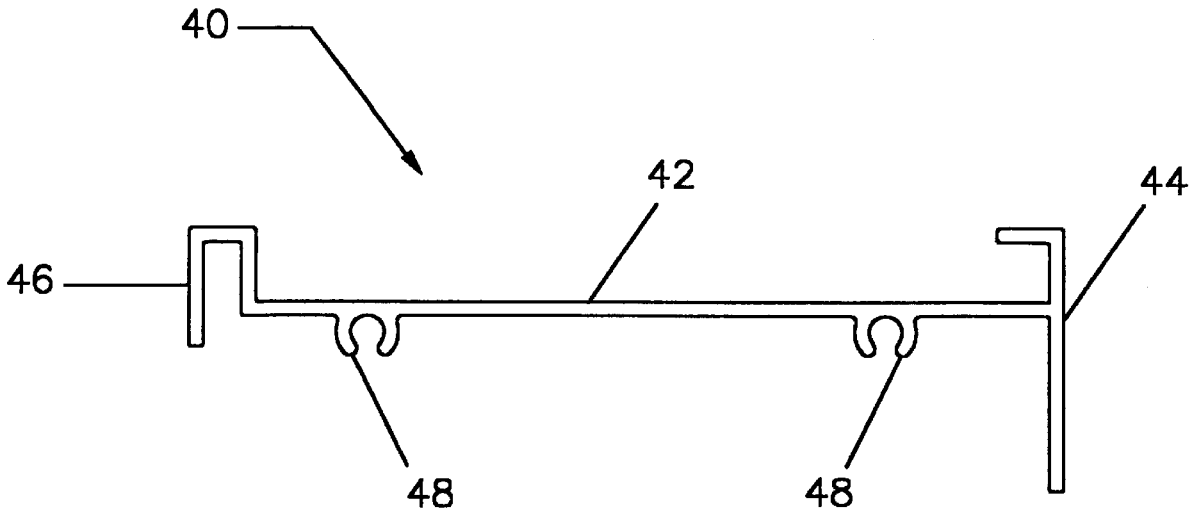
FIGS. 5 to 10 are end views of the frame members, as follows.
Figure 5:
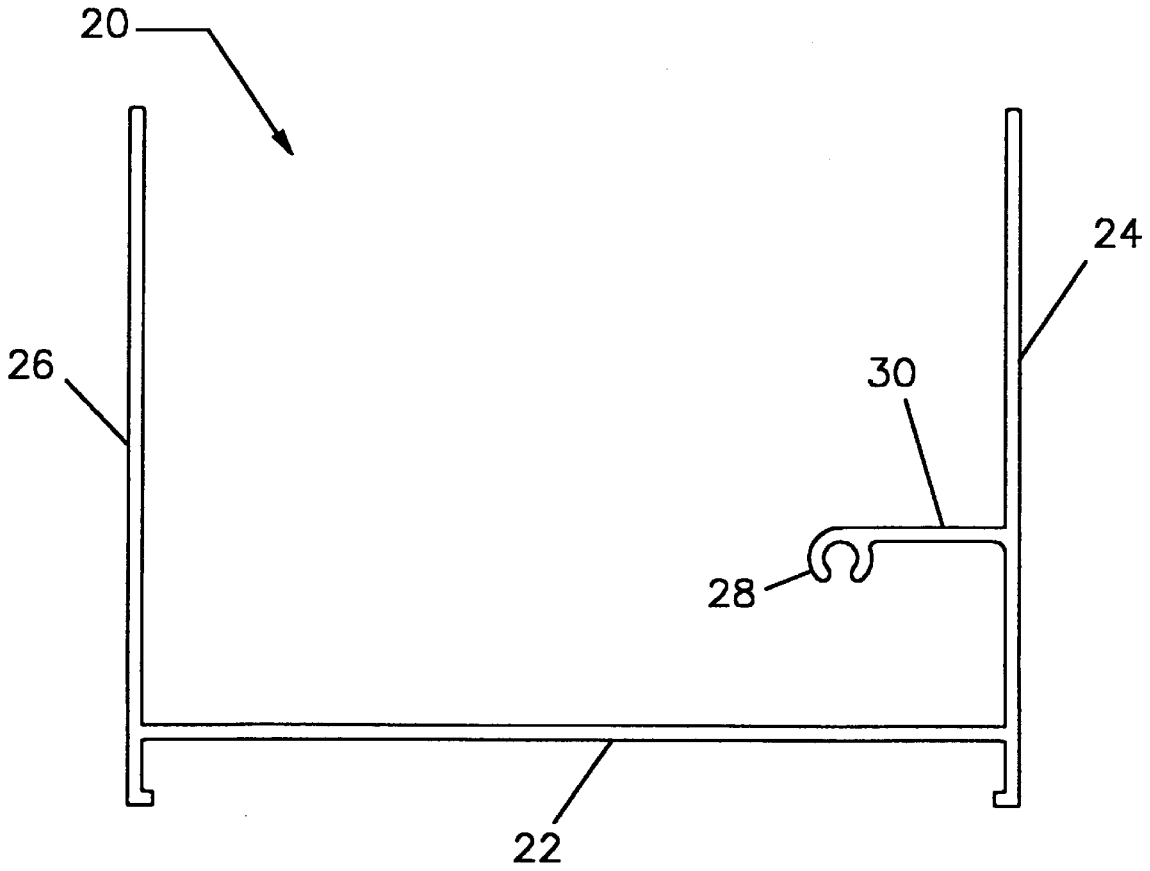

Referring to FIG. 4, one or more pipes 170 connected to holes in the sill 20 and leading to waste lines of the building plumbing system or to some other suitable interior destination conduct water away from the sill. The pipes may lead into the building, as shown, out to a downspout outside the building (not shown), or to pipes within the building walls immediately below (also not shown). The sills 20 can, alternatively, have holes in the bottom web portion that release the water onto flashing 160, which has an upwardly extending rear darn portion 160*d*, a base portion 160*b* under the sill and over the building structure S below, and a lip 160*e*. The water runs off the flashing from the lip and flows down the building wall in such an installation. The flashing 160 also captures water that leaks from the lower joints between the sills and the jambs and vertical members.

FIG. 4 also shows a suitable sight screen 14 in detail. Brackets 14*b* that are suitably fastened to the jambs and intermediate vertical frame members support inclined horizontal blades 14*hb*, which snap onto the brackets. The sight screen 14 of FIGS. 1, 2, and 4 is known per se. As mentioned above, many forms of sight screens are suitable for use in the system of the present invention. Different sight screens can be used in a given expanse of a louver system.

FIGS. 1 to 4 and the above description illustrate and describe the concept of the invention. FIGS. 5 to 17 and the following description relate to an exemplary embodiment. Each of the members of the framework is a piece cut to length from an extrusion of aluminum and thus is of uniform cross-section along its length, except where it is cut away, as described below. The structure of each member of the frame work is from the drawings and the following table.

| FIG. No. | Member | Web | Front flange | Rear flange | Screw bosses | Other |
|---|---|---|---|---|---|---|
| 5 | sill 20 | 22 | 24 | 26 | 28 | support ledge 30 |
| 6 | header 40 | 42 | 44 | 46 | 488 | — |
| 7 | jamb 60 | 62 | 64 | 66 | 68 | — |
| 8 | jamb cover 70 | 72 | — | — | — | hooks 76 |
| 9 | half vertical 81 | 82 | 84 | 86 | 88 | slip joint offset 90 |
| 10 | inter. horiz. 100 | 102 | 104 | 106 | 108 | support ledge 100 |

As may be seen in FIGS. 11 and 12, portions of the front flange 64 of the jamb are notched to allow the front flanges 44, 104, and 24 of the header 40, the intermediate horizontal frame members 100 and the sill 20 to fit to the jamb flush with the front flange 64 of the jamb and the ends of the header 40 and the intermediate horizontal frame members to butt up against the web 62 of the jamb. The front flange 24 of the sill is notched to allow the end of the web portion 22 to be received under the lower ends of the jamb flanges 64 and 66. The rear flange 26 of the sill lies behind and overlaps the lower portion of the rear flange 66 of the jamb 60.

U-shaped cuts are made in the web portion of the jamb at the level of the juncture of the jamb with the sill 20 and each intermediate horizontal frame member 100 and the tabs 62*t* formed by the slits are bent out to leave drain holes 72. Where a unit opening receives a blank-off panel, the tabs 62*t* are either not formed or are not bent out. The drain holes 72 can also be formed by scoring and coining the web portions 62 and 82, which are bent out in the field as needed. Slit or scored and coined portions may, of course, be knock-outs, thus leaving holes without tabs. The jamb 60 is joined to the header and each intermediate horizontal frame member 100 by screws that pass through holes 74 (see FIG. 12) in the web portion 62 of the jamb and into the screw bosses 48 and 108 and to the sill 20 by screws that pass through holes 34 in the web 22 of the sill into the screw bosses 68 of the jamb. After the jamb is fastened to the header, intermediate horizontal frame members and the sill, the jamb cover 70 (FIG. 8) is snapped into the transverse gap between the ends of the flanges 64 and 66 of the jamb, the hooks 76 engaging ribs 64*r* and 66*r* on the jamb flanges. The cover 70 makes the jamb tubular so as to retain water draining into it from the intermediate horizontal members and direct it to the sill. It is possible to omit the drain holes of the jambs and the jamb cover and drain louver units adjacent the jambs to the intermediate vertical frame member.

Figure 7:
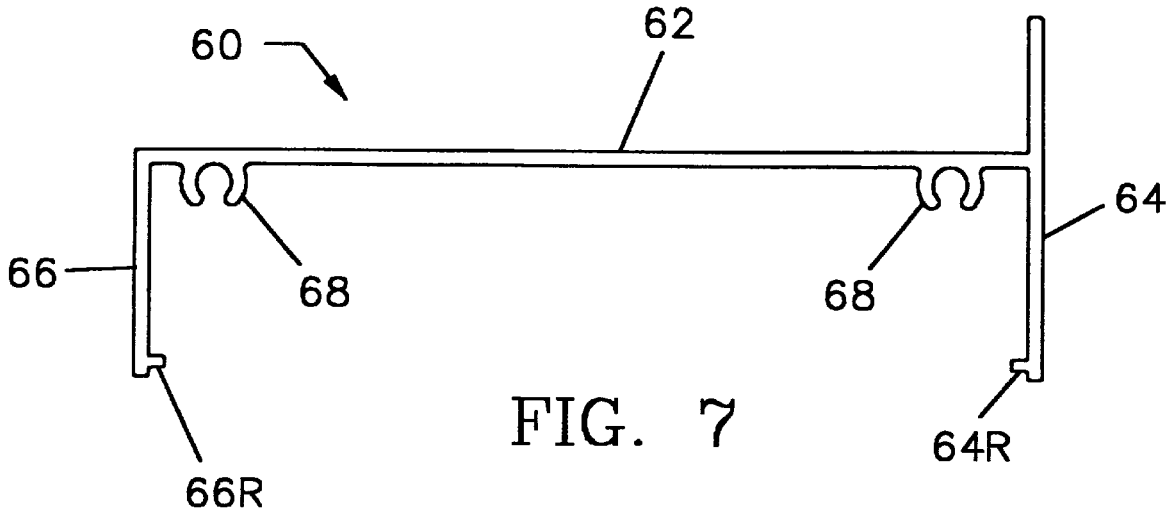
Figure 8:
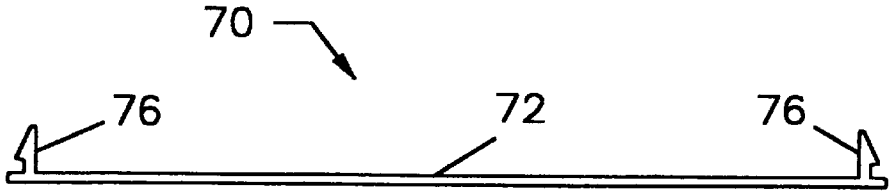
Figure 9:
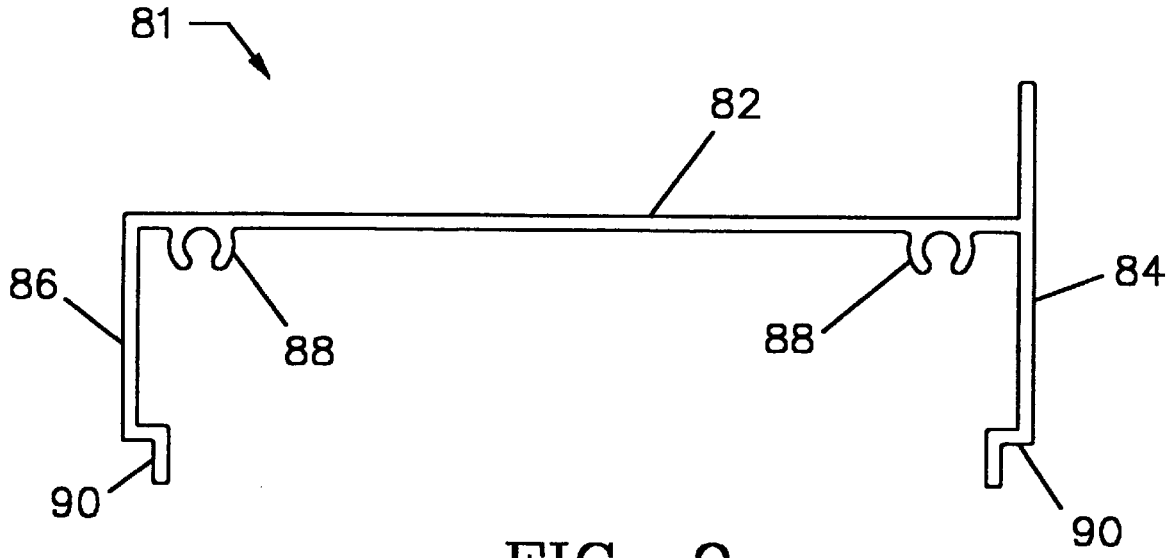
Figure 10:
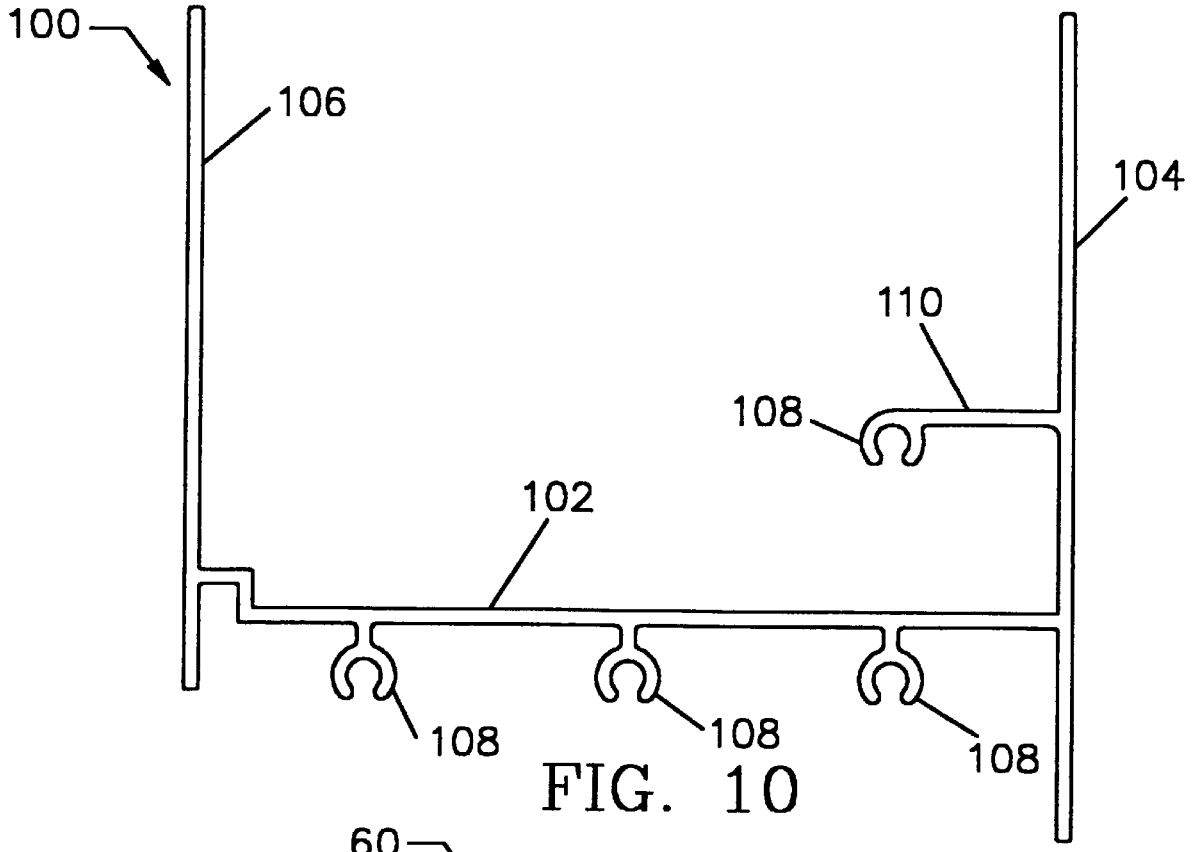

Referring to FIG. 13, each intermediate vertical frame member 80 is an assembly formed by joining a half vertical member 81 (FIG. 9) and a jamb 60 (FIG. 7). The ribs 64*r* and 66*r* on the ends of the flanges 64 and 66 of the jamb 60 fit into the slip joint offsets 90 of the half vertical member 81, such that the outer faces of the flanges 64 and 84 are flush and outer faces of the flanges 66 and 86 are flush. The joints between the jamb 60 and the header 40, the intermediate horizontal frame members 100 and the sill 20 and between the half intermediate vertical frame member 81 and the header 40, the intermediate horizontal frame members 100 and the sill 20 are the same as those described above with respect to FIG. 12, as is apparent from examining FIG. 13. No additional detailed description is needed or provided.

The embodiment of the frame work shown in FIG. 5 to 13 and described above provides modular framework subassemblies, each consisting of a header 40, one or more intermediate horizontal frame members 100, and a sill 20 fastened between either two jambs 60 or between a jamb 60 at one end and a half vertical member 81 at the other end. The subassemblies fit together at the slip joints between the jambs 60 and the half vertical members 81. The subassemblies can be shop-assembled and shipped to the job site, or the parts can be shipped to the job site knocked down and field-assembled. The subassemblies are relatively easy to handle and install in the building.

As mentioned above, an advantage of the modular louver system of the present invention is the ability to provide louvers of various designs or blank-off panels in selected unit openings of the framework. The architect need not be concerned with the appearance of the array, because the sight screen hides the array from view. The engineers can select the louvers and blank-off panels needed for the mechanical requirements for air intake and exhaust and for closing off selected space behind the louver system.

An example of an excellent louver module 140, which provides an extremely high water-capture rate and a relatively low flow resistance, given its effectiveness in water removal, is shown in FIGS. 14 and 15. It has a frame formed by a channel-shaped header 142, a pair of sill members 144 of "L" shape in cross-section, and a pair of jambs 146, the jambs having screw bosses 148 to receive screws that pass through holes in the sill members and the header to connect the frame. Vertical blades 150 are fastened to the header and sill members, such as by screws that pass through holes in the sill members and header into "basket weave" holes (not shown) in each end of each blade—a basket-weave hole is formed by making a pair of slits in the blade parallel to the ends and bending out the piece between the slits. It is preferred to avoid using screw bosses on the blades, which is a common practice, in order to maintain a maximum free area for air flow. The blades may be configured to provide a maximum free area in accordance with the principles disclosed in U.S. Pat. No. 5,048,253 (Olsen), which is incorporated into this specification for all purposes. Each of the blades is generally V-shaped, with a rounded juncture 150*a* between front and rear legs 150*f* and 150*r* and hook portions 150*ha* at the apex and 150*he* at the downstream edge for capturing water that collects on and is blown along the blade surfaces and draining it to the bottom. The two sill members 144 leave a gap for water to drop onto the sill 20 or the horizontal frame member 100 below. The rear flanges 26 and 106 of the sill and the intermediate horizontal frame members are high enough to capture water blown from the downstream edges of the sills 144 of the louver unit frame. As shown in FIG. 4, each louver module, whether of the form of FIGS. 14 and 15 or of some other design, is inserted into the unit opening (see FIG. 2) by orienting it obliquely to the framework, inserting the lower edge to seat the front sill 144 on the support ledge 30 or 110 and tilting the upper end into engagement with front flanges of the members of the framework that form the unit opening. The louver module is secured in place in any suitable way, such as by mechanical fasteners or spring retainers (not shown).

The "Z" blade 150' shown in FIG. 16 can be substituted for the "V"-blade in the louver module of FIGS. 14 and 15. The "Z" blade 150' has a front leg 150*fl*, a middle leg 150*ml* and a rear leg 150*ri*. Hook portions 150*hp* at the downstream edge of each leg capture water blown along the respective leg and drain it to the bottom of the louver unit.

Selected unit openings of the framework may receive blank-off panels, such as the panel 180 shown in FIG. 17 and 18. A sandwich of cover sheets 182 of metal or plastic and an insulating core 184 of a polymeric foam is received within a frame 186 formed by channel members that meet at mitered comers 186*c*. A gasket 188 adhered to the outer face of the frame seals against the front flanges of the frame members of the framework that border the unit opening in which the panel is received. As mentioned above, blank-off panels may have glass or plastic sheets to admit light. Off-the-shelf stock windows can be used.

We claim:

1. A modular louver assembly comprising a peripheral frame having a sill, a header and jambs defining a rectangular primary opening;

a plurality of intermediate frame members joined to the peripheral frame and dividing the primary opening into a plurality of rectangular modular unit openings;

a louver module received in at least one of the unit openings, the louver module including module frame members and a plurality of louver blades affixed to the module frame members and the louver module being a self-supporting unit; and a sight screen mounted on the peripheral frame, overlying substantially the entire primary opening, substantially concealing the louver module, and providing a selected architectural appearance.

2. A modular louver assembly according to claim 1 wherein one said louver module having vertical blades is received in a unit opening immediately above the sill and the sill is channel-shaped and defines a water collection and drainage channel for water captured by the louver module above it.

3. A modular louver assembly according to claim 2 wherein one of said intermediate frame members is a horizontal intermediate frame member, one said louver module having vertical blades is received in a unit opening immediately above the horizontal intermediate frame member, and the horizontal intermediate frame member is channel-shaped and defines a water collection and drainage channel for water captured by the louver module above it.

4. A modular louver assembly according to claim 3 wherein the jambs are tubular and define flow conduits, the horizontal intermediate frame member is joined to one of the jambs at a juncture, and the jamb has a hole at the juncture that opens to the drainage channel to receive water from the drainage channel for flow through the flow conduit.

5. A modular louver assembly according to claim 2 wherein each of the vertical blades is generally V-shaped in cross section, is rounded at an apex between front and rear leg portions, and has a first water-trapping hook-shaped rib at the apex and a second water-trapping hook-shaped rib at a rear extremity of the rear leg portion.

6. A modular louver assembly according to claim 2 and further comprising means for draining water from the sill channel.

7. A modular louver assembly according to claim wherein the sill is channel-shaped and defines a water collection and drainage channel, the jambs are tubular and define flow conduits, the jambs have holes that open to the sill drainage channel, wherein said intermediate frame members include a tubular intermediate vertical frame member that extends between and is joined to the sill and the header and defines a vertical frame member conduit, a first channel-shaped intermediate horizontal frame member that extends between and is joined to one jamb and said intermediate vertical frame member, a second channel-shaped horizontal intermediate frame member that extends between and is joined to the other jamb and said intermediate vertical frame member, and wherein each jamb and said intermediate vertical frame member have holes registering with the horizontal frame member to which they are joined so as to permit water collected in the channels of the horizontal frame members to drain into the jamb conduit or vertical frame member conduit to which they are joined.

8. A modular louver assembly according to claim 7 wherein each louver module is insertable into and removable from the unit opening that receives it without disassembling the louver module, the peripheral frame or any intermediate frame member.

9. A modular louver assembly according to claim 8 and further comprising means for releasably securing each louver module in the unit opening.

10. A modular louver assembly according to claim 7 wherein said intermediate vertical frame member is formed by two longitudinally coextensive laterally adjacent generally U-shaped pieces that mate side by side at slip joints.

11. A modular louver assembly according to claim 10 wherein each horizontal intermediate frame member has screw bosses that receive screws having heads within the vertical intermediate frame member, the screws having been installed before said U-shaped pieces were mated.

12. A modular louver assembly according to claim 1 wherein each louver module is selected to have specified water-removing characteristics.

13. A modular louver assembly according to claim 1 wherein said louver blades of the louver module are vertical blades.

14. A modular louver assembly according to claim 13 wherein the vertical blades are extrusions of a polymeric material.

15. A modular louver assembly according to claim 14 wherein the sight screen is configured to shade the louver blades from direct sunlight and the louver blades include materials that are not resistant to sunlight.

16. A modular louver assembly according to claim 1 wherein the sight screen has a plurality of elongated horizontally extending blades mounted in vertically spaced apart relation.

17. A modular louver assembly according to claim 1 wherein the sight screen has an open grillwork presenting a substantially regular pattern of openings.

18. A modular louver assembly according to claim 1 and further comprising a blank-off module received in at least one of the unit openings.

19. A modular louver assembly according to claim 18 wherein the blank-off module has a frame and a sandwich panel mounted in the frame, the sandwich panel having a core of a thermally insulating material and skins of rigid sheet material.

20. A modular louver assembly according to claim 18 and further comprising means for sealing the blank-off module within the unit opening to prevent flow of air and moisture through the unit opening.

21. A modular louver assembly comprising a peripheral frame having a sill, a header and jambs defining a rectangular primary opening, the sill being generally U-shaped and defining a water-collection channel;

a plurality of intermediate tubular vertical frame members joined to the sill and header;

a plurality of intermediate channel-shaped horizontal frame members joined between the jambs and the intermediate frame members and forming drainage channels;

the frame members dividing the primary opening into a plurality of rectangular modular unit openings and each vertical frame member having openings to receive water from the drainage channels of the horizontal frame members;

louver modules received in at least some of the unit openings, each louver module including module frame members and a plurality of louver blades affixed to the module frame members and each louver module being a self-supporting unit; and a sight screen mounted on the peripheral frame, overlying substantially the entire primary opening, substantially concealing the louver module, and providing a selected architectural appearance.

22. A modular louver assembly according to claim 21 wherein each intermediate vertical frame member is formed by two longitudinally coextensive laterally adjacent generally U-shaped pieces mated side by side at slip joints.

23. A modular louver assembly according to claim 22 wherein each horizontal intermediate frame member has screw bosses that receive screws having heads within the vertical intermediate frame member, the screws having been installed before said U-shaped pieces were mated.

24. A modular louver assembly according to claim 21 wherein at least some of the louver modules have vertical blades.

25. A modular louver assembly according to claim 24 wherein each of the vertical blades is generally V-shaped in cross section, is rounded at an apex between front and rear leg portions, and has a first water-trapping hook-shaped rib at the apex and a second water-trapping hook-shaped rib at a rear extremity of the rear leg portion.

26. A modular louver assembly according to claim 21 wherein each louver module is selected to have specified water-trapping characteristics.

27. A modular louver assembly according to claim 21 wherein each louver module is insertable into and removable from the unit opening that receives it without disassembling the louver module, the peripheral frame or any intermediate frame member.

28. A modular louver assembly according to claim 27 and further comprising means for releasably securing each louver module in the unit opening.

29. A modular louver assembly according to claim 21 and further comprising a blank-off module received in one of the unit openings, the blank-off module having a frame and a sandwich panel mounted in the frame, the sandwich panel having a core of a thermally insulating material and skins of rigid sheet material.

30. A modular louver assembly according to claim 29 and further comprising means for sealing the frame of the blank-off module within the unit opening to prevent flow of air and moisture through the unit opening in which the blank-off panel is installed.

* * * * *